United States Patent [19]

Kemeny

[11] Patent Number: 4,932,305

[45] Date of Patent: Jun. 12, 1990

[54] HIGH CURRENT SHORTING SWITCH FOR RAPID FIRE ELECTROMAGNETIC LAUNCHERS

[75] Inventor: George A. Kemeny, Wilkins Township, Allegheny County, Pa.

[73] Assignee: Westinghouse Electric Corp., Pittsburgh, Pa.

[21] Appl. No.: 638,328

[22] Filed: Aug. 6, 1984

[51] Int. Cl.[5] ..... F41B 6/00

[52] U.S. Cl. ..... 89/8; 124/3; 335/147; 335/149

[58] Field of Search ..... 89/8; 124/3; 310/10-14; 318/135; 200/144 AP, 147 R; 361/3, 5, 8, 9, 13, 194, 198, 93; 307/252 Q, 252 N, 247 A, 542.1, 693, 645; 335/195, 147

[56] References Cited

U.S. PATENT DOCUMENTS

| | | | |
|---|---|---|---|
| 3,002,065 | 9/1961 | La Tour | 335/147 X |
| 3,070,677 | 12/1962 | Lowry | 335/195 X |
| 3,321,668 | 5/1967 | Baker | 361/8 |
| 3,339,110 | 8/1967 | Jones | 361/13 |
| 3,402,302 | 9/1968 | Coburn | 361/6 |
| 3,454,832 | 7/1969 | Hurtle | 361/13 X |
| 3,743,859 | 7/1973 | Exner | 307/252 Q X |
| 3,935,509 | 1/1976 | Eidinger | 361/9 X |
| 4,319,168 | 3/1982 | Kemeny | 89/8 X |
| 4,369,692 | 1/1983 | Kemeny | 89/8 |
| 4,423,662 | 1/1984 | McAllister | 89/8 |
| 4,426,562 | 1/1984 | Kemeny | 200/151 |
| 4,433,607 | 2/1984 | Kemeny | 89/8 |
| 4,437,383 | 3/1984 | Deis et al. | 89/8 |
| 4,473,875 | 9/1984 | Parsons et al. | 89/8 X |
| 4,500,934 | 2/1985 | Kinsinger | 361/13 X |

FOREIGN PATENT DOCUMENTS 3319998 2/1984 Fed. Rep. of Germany ..... 89/1.8

OTHER PUBLICATIONS

DTIC Technical Report AFATL-TR-81-99, by I. R. McNab and D. W. Deis, Nov. 1981, pp. 93 and 94.

*Primary Examiner*—Stephen C. Bentley
*Attorney, Agent, or Firm*—R. P. Lenart

[57] ABSTRACT

A switching system for switching large electric currents such as those utilized in the electromagnetic launching of projectiles, includes a plurality of controllable switching elements such as solid state switching devices which are electrically connected in parallel with each other and are also electrically connected in parallel with a pair of mechanical switch contacts. Current flow through the solid state switching devices also flows through a series connected structure which utilizes electromagnetic forces generated by this current to close the mechanical contacts, thereby shorting across the solid state switching device circuit branches. This switching system can be utilized in an electromagnetic projectile launching system to conduct current between a pulse current source and a pair of projectile launching rails. Launch current flow is initiated by the switching system and the mechanical switch contacts remain closed until current is interrupted at a current zero following a projectile launch. Utilization of the mechanical contacts reduces the required number of parallel controllable switching devices, thus making it economically and technically more attractive to use solid state devices.

12 Claims, 2 Drawing Sheets

HIGH CURRENT SHORTING SWITCH FOR RAPID FIRE ELECTROMAGNETIC LAUNCHERS

BACKGROUND OF THE INVENTION

This invention relates to switches for switching very large electric currents and has particular application to switches used in switching the very large currents employed in the electromagnetic propulsion of projectiles.

Electromagnetic projectile launchers have been constructed which include a pair of generally parallel conductive projectile launching rails, a sliding conductive armature for conducting current between the rails and propelling a projectile along the rails, a source of high current and a switching system for switching current from the current source to the rails. Firing a burst of electromagnetically accelerated projectiles will generally require prestorage of energy which is depleted by the successive energy requirements of each projectile acceleration. Two distinctly different systems have been proposed. Each involves the prestorage of energy in the form of the kinetic energy of a rapidly revolving rotor of an electrical generator.

One system involves a homopolar generator-inductor system in which a homopolar generator charges an inductor to a firing current level and suitable switching then fires a projectile after which the charging circuit is reestablished so that the inductor can be rapidly recharged back to the same firing current level for a successive shot. The firing switch or switches for this type of operation commutate the projectile accelerating current into the breech end of the projectile rails and therefore the firing switch or switches conduct current continually except during the very brief successive projectile acceleration intervals. Thus these switches must, without overheating and deterioration, accommodate enormous magnitudes of $I^2t$ (amp$^2$sec) which in turn dictates the use of heavy mechanical switches with massive contact areas. Examples of such switches can be found in my Pat. Nos. 4,426,562 and 4,433,607.

The second switching system is a rotating pulse generator system in which an alternator of high short circuit current rating prestores kinetic energy and produces at its output terminals distinct and successive voltage pulses. In its simplest form, such a generator is connected to the breech ends of the projectile launching rails and if the breech electrical loop is shorted by the presence of a projectile package, that projectile will be fired because the voltage pulse in combination with the circuit and projectile rail parameters results in the desired and consistent accelerating current variation. In actuality, such a system will additionally require a series closing switch or switch array which closes the circuit to fire a projectile and which can or may open during the next current zero. This firing switch or switching system has to be extremely accurately timed so that accelerating current flow is started precisely at a desired point on the pulse voltage curve. As kinetic energy is depleted and the generator voltage drops, the timing of switch closure is repeatably adjusted so as to continuously result in a constant muzzle velocity for successive projectiles. A preferred switching system to accomplish this task would most likely utilize arrays of solid state devices. However, if solid state devices alone are used to form the switching system, an excessively large number of state-of-the-art devices would be required to handle the currents needed to produce acceptable acceleration of a practical projectile. Therefore, it is desirable to construct a switching system which takes advantage of the operating characteristics of solid state devices without requiring an excessive number of these devices.

SUMMARY OF THE INVENTION

A switching system for switching large electric currents constructed in accordance with the present invention comprises: a plurality of controllable switching devices electrically connected in parallel with each other; a current actuated mechanical switch having a pair of contacts electrically connected in parallel with the parallel connection of the controllable switching devices; and means for shorting the mechanical contacts in response to current flow through the controllable switching devices, thereby limiting the power dissipated in the switching devices during each current switching operation. This switching system preserves the required precise and adjustable timing of circuit closure and initiation of current flow provided by controllable switches, such as solid state devices, but uses a mechanical switch to conduct most of the current, thereby reducing the number of parallel connected controllable switching devices which would otherwise be required.

An electromagnetic projectile launching system constructed in accordance with this invention includes: a pair of generally parallel conductive rails; means for conducting current between the rails and for propelling a projectile along the rails; a pulse current source; and a switching system for switching current from the pulse current source to the rails wherein the switching system includes a plurality of controllable switching elements such as solid state switching devices electrically connected in parallel with each other, a current actuated mechanical switch having a pair of contacts electrically connected in parallel with the parallel connection of controllable switching devices, and means for shorting the mechanical contacts in response to current flow through the controllable switching devices, thereby limiting the power dissipated in the controllable switching devices during each current switching operation. By using a pulse current source, current can be interrupted following the launch of a projectile during a current zero and the mechanical contacts of the switching system can be subsequently opened so that they are not used to interrupt any current flow.

The electromagnetic launching systems of this invention accelerate a projectile by a method comprising the steps of: switching current from a pulse current source through a plurality of parallel connected controllable switching devices to a pair of projectile launching rails and through a means for conducting current between the rails and for propelling a projectile along the rails; and shorting or crowbarring the controllable switching devices through a pair of mechanical contacts, wherein the mechanical contacts close in response to current flow through the controllable switching devices, thereby limiting the power dissipated in the controllable switching devices during each switching operation, and limiting the required number of such parallel connected controllable switching devices.

DESCRIPTION OF THE PREFERRED EMBODIMENTS

Figure 1:
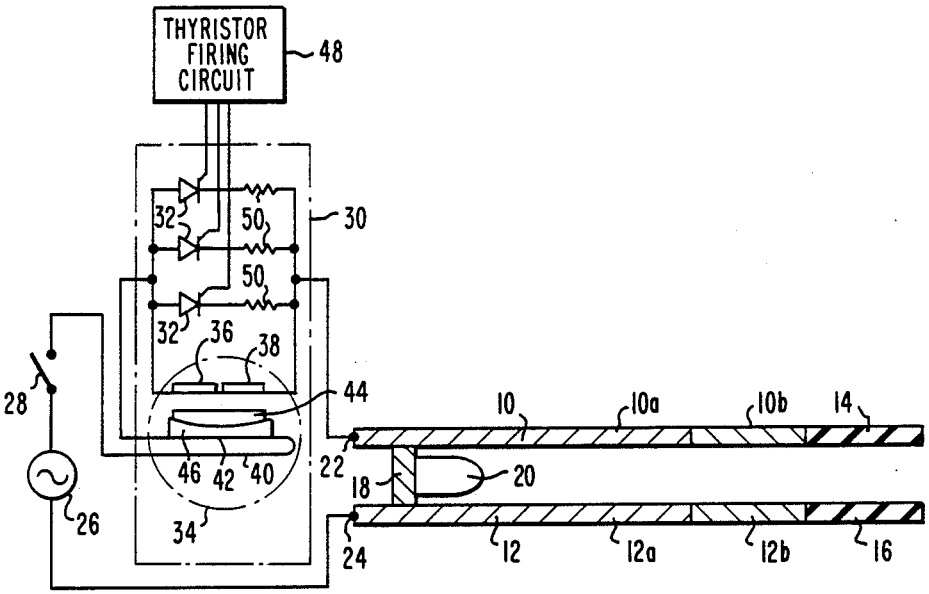
FIG. 1 is a schematic diagram of an electromagnetic projectile launching system constructed in accordance with one embodiment of the present invention.

Referring to the drawings, FIG. 1 is a schematic diagram of an electromagnetic projectile launching system constructed in accordance with one embodiment of the present invention. This system includes a pair of generally parallel conductive projectile launching rails 10 and 12. Each of these rails includes a high conductivity section 10*a* and 12*a*, and a more resistive section 10*b* and 12*b*. Insulators 14 and 16 are positioned adjacent to the muzzle ends of rails 10 and 12. A sliding conductive armature 18 serves as means for conducting current between the rails and for propelling a projectile 20 along the rails. The breech ends 22 and 24 of rails 10 and 12 are connected to a pulse current source 26 through a switch 28 and a switching system 30.

Switching system 30 includes a plurality of controllable switching elements such as solid state switching devices in the form of thyristors 32 which are electrically connected in parallel with each other and a mechanical switch 34 having a pair of contacts 36 and 38 which are electrically connected in parallel with the parallel connection of thyristors 32. Mechanical switch 34 also includes a fixed conductor 40 and a movable conductor 42 which are arranged such that current flows in opposite directions in these conductors. A shorting member 44 is attached to movable conductor 42 by an insulating member 46.

In operation, following the closing of switch 28, at the proper point in the generator voltage pulse, the thyristor firing circuit 48 turns on thyristors 32 which initially conduct current to the rails. Since conductors 40 and 42 are connected in series with the thyristor array, the thyristor current also flows through these conductors thereby creating electromagnetic repulsion forces which tend to separate these conductors and force shorting member 44 into contact with contacts 36 and 38. This effectively shorts out the thyristors. Resistors 50 are inserted in series with each thyristor to assure relatively equal current division and to create a small voltage which speeds up current commutation into the mechanical contact circuit branch.

In order to perform the function of passing most of the $I^2t$ and thereby drastically reducing the required number of parallel solid state switching devices, the mechanical switch 34 must short across its contacts in a time interval which is small compared to the total projectile acceleration. A projectile acceleration duration of 2 to 3 milliseconds is reasonable and therefore switch closure should snot take more than about 500 microseconds.

In a practical system, switch contacts 36 and 38 need to be able to withstand only in the order of 2 or 3 kilovolts in the open position. If the contacts are separated by gas or air, a single millimeter spacing would be more than sufficient and thus the contact stroke can be exceedingly short. This is beneficial since it allows rapid contact closure without excessive force or contact velocity requirements.

Because of the close mechanical contact spacing, high currents, and the need for repeated operations without contact deterioration, all arcing in the mechanical switch contacts must be avoided. Prestrike arcing should not occur since at the time of contact closure, voltage across the contacts will be at most a few tens of volts. Arcing during contact opening is avoided by insuring that the contacts are never used to interrupt current. Current interruption must therefore be performed by other circuit elements before the contacts of switch 34 open. The preferred circuit opening scheme would most likely be to use a resistive muzzle bore portion as shown in FIG. 1 to help in the current reduction and then finally interrupting current in the rail bore or muzzle during a current zero which occurs immediately after the projectile acceleration. The mechanical switch contacts would remain closed for a few milliseconds during which time voltage pulses may appear across the rails and the circuit will only then be opened. At most, the mechanical switch contacts, during separation, may conduct a minute current because of interrail capacitance. However, this current would not result in arcing which can damage the contacts. After the contacts have opened, for example, 5 or 10 milliseconds after a current zero, a new projectile can be inserted into the breech of the conducting rails for a subsequent projectile launch.

Figure 2:
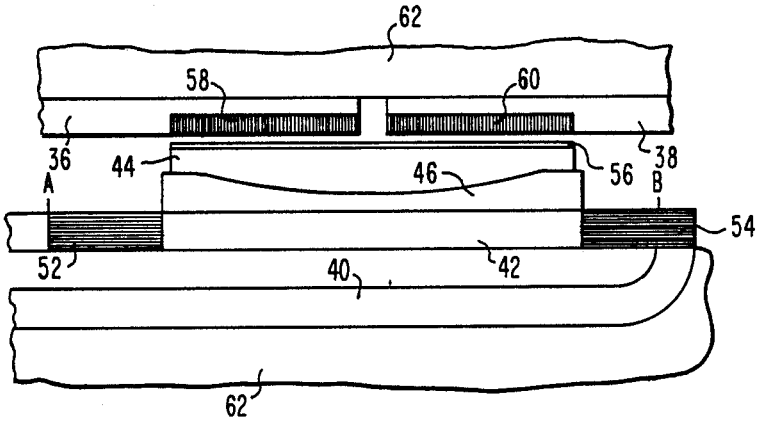
FIG. 2 is an elevation view of the mechanical switch in the switching system of the launcher of FIG. 1.

FIG. 2 is an elevation view of the mechanical switch 34 of FIG. 1. Since only a very short contact stroke is required, this switch utilizes an electromagnetic repulsion scheme for rapid movement of the contact shorting element. Movable conductor 42 is shown to be connected by flexible braided or multiple leaf conductors 52 and 54 to allow the required short stroke movement. The contact shorting element 44 may be solid aluminum with a suitable plating 56 on the contact area. The mating stationary contacts 36 and 38 may include a dense copper fiber structure 58 and 60 with one end of each fiber making contact with the contact shorting element and the other end of the each fiber embedded in a high conductivity matrix, constructed of, for example, copper. The insulating member 46 which attaches the shorting element 44 to the movable conductor 42 may be resilient and the braided conductors 52 and 54 may be replaced by a hinge structure. The movable conductor 42 may itself be replaced by a layered and possibly transposed conductor so that it is sufficiently flexible and correctly spring biased for the required short stroke movement. If braided conductors are used, springs or resilient insulation can be used to bias the contact shorting element 44 about one millimeter from the stationary contacts and to return the contact shorting element to this position after cessation of current following a current switching operation. This resilient insulation, such as for example silicon rubber, may partially fill the volume between the fixed conductor 40 and the movable conductor 42. A suitable restraining structure 62 would, of course, be required to hold the switch elements in their proper locations.

Figure 3:
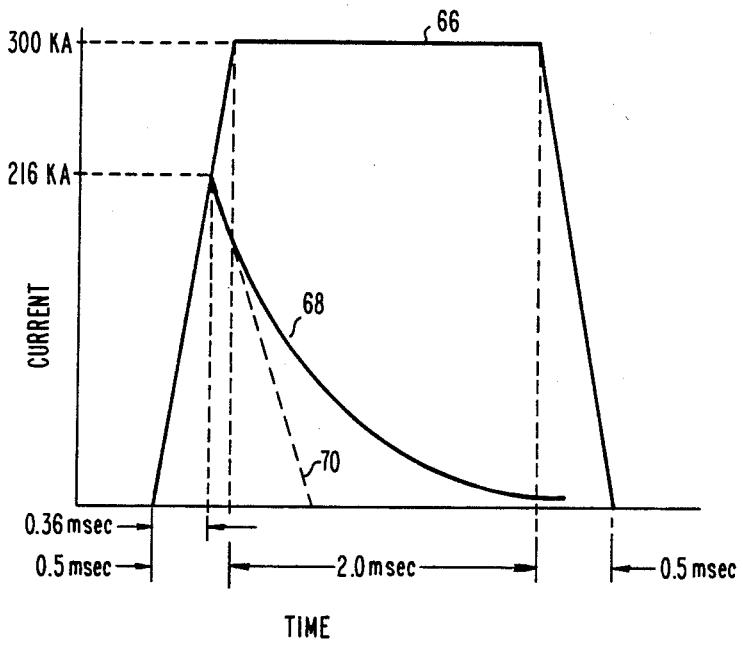
FIG. 3 is a curve illustrating typical current flow in the launcher of FIG. 1 during a projectile acceleration.

To show that the required shorting element movement and hence contact closure can be obtained in less than 500 microseconds, contact mass, forces, travel distances and velocities can be readily estimated. For example, assuming that the distance between points A and B in FIG. 2 is 10 centimeters and that the width of the opposing fixed and movable conductors is 5 centimeters in a direction perpendicular to the plane of the figure, the repulsive force can be calculated to be roughly equal to $10^6I^2$ Newton for a gap between the fixed and movable conductors of 5 millimeters, if the current is rapidly rising and is therefore in a relatively thin layer at the inner conductor faces. To calculate velocities, travel distances, forces, etc., the current must be expressed as a function of time. A reasonable estimate for a highly desirable current waveform for accelerating a projectile is shown in FIG. 3. This current is assumed to rise to its full value of 300 kiloamps in a period of 0.5 millisecond and thus the current rise portion is represented by $I=600\times10^6t$, where t is in seconds. During the initial 0.5 millisecond of current rise, the following equations apply.

| | | |
|---|---|---|
| Force on armature $= 10^{-6}I^2 = 360 \times 10^9t^2$ | (newton) | (1) |
| Acceleration of armature $= 360 \times 10^9t^2/M$ | (m/sec$^2$) | (2) |
| Velocity of armature $= 120 \times 10^9t^3/M$ | (m/sec) | (3) |
| Armature travel distance $= 30 \times 10^9t^4/M$ | (meter) | (4) |

In the above equations, t is in seconds from the point of current initiation and M is the mass of the moving components in kilograms, that is of the moving conductor, insulating layer and contact shorting element.

It should be apparent that contact bounce must be prevented. The resilience of the metal fiber contact structure will help to prevent contact bounce and additional means can be provided to reduce contact damage on impact. For example, some of the contact shock can be absorbed by stationary elastic yielding structures beyond the contact area, which oppose and help to arrest the moving contact structure after it has traveled the one millimeter to make initial contact. Additionally, as required, current flowing in the closed switch contacts can be in the same direction as current flowing in the launcher armature, in which case contact forces increase when the circuit is initially closed, or if current directions are opposite, contact forces decrease after the contacts, close. The switch can also be configured such that currents in the switch contacts and the armature, flow in orthogonal directions so as to reduce their force interactions.

Because the FIG. 2 construction yields two gaps in series, a one millimeter movement to initiate contact should be more than adequate. To determine whether this one millimeter movement can be readily attained in less than 0.5 millisecond, the magnitude of the moving mass M in equation 4 must be estimated. For the projectile accelerating current flow as shown in FIG. 3, the $I^2t$ per shot will be equal to $210\times10^6A^2S$. Assuming, for example, that the maximum burst length is 30 shots per second during which adiabatic conditions exist in the moving conductor, then the moving conductor cross section and weight for a given temperature rise can be calculated. For example, using an aluminum conductor which may involve transposed sections to yield a more uniform current distribution, and may also yield the desired flexibility, will require a current cross section of 8.8 cm$^2$ to give about 4° Kelvin conductor temperature rise per shot. This results in an acceptable total rise of 120° Kelvin for a maximum burst length. An 8.8 cm$^2$ conductor cross section, with a length of 10 centimeters, yields for aluminum a mass of 240 grams. For copper, the same 4° Kelvin rise per shot would give a smaller cross section of 5.0 cm$^2$ but a heavier mass of about 450 grams.

If the movable contact shorting element is assumed to be tapered as shown in FIG. 2, with a silver contact area plating and if the opposing dense and resilient copper fiber matrix with fiber ends contacting the plated area are assumed, then the required contact areas can be estimated. If the contact area were solid copper, about 5 cm$^2$ would be required. With copper fibers, a stacking factor of 30 or 40% should be readily attainable but a conservative stacking factor of 25% can be assumed to yield an individual contact area of 20 cm$^2$. Thus, the total movable shorting element length is 8 centimeters plus the gap between the stationary contacts. Roughly, this yields a movable contact mass of 140 grams including a heavily silver plated contact surface. Thus the mass of the aluminum movable conductor plus the plated moving contact shorting element is about 380 grams. If 120 grams is added for springs, braid, moving insulation, etc., then the total mass, M, would be equal to 0.5 kilogram.

Now the time, t, in equation 4 can be calculated. Assuming a travel distance of 1 millimeter, the time, t, is then equal to 359.3 microseconds. The various parameters at contact closure can now be calculated using a rounded time of 360 microseconds. Under these conditions, the current at contact closure is 216 kiloamps as shown in FIG. 3. The force on the movable conductor at contact closure is 46.6 kilonewton, the acceleration of the movable conductor is $93.3\times10^3$ m/sec$^2$, and the velocity of the movable conductor is 11.2 m/s.

In making these calculations, the spring force or bias force which normally keeps the mechanical switch contacts open and which is opposed by the launch current repulsion force which closes the contacts, was neglected. Since the contact reopening stroke after current cessation can occur, for example, in 10 millisecond whereas closure was effected in 0.36 millisecond, the spring forces which reopen the contacts are negligible compared to the current induced closing forces. It has therefore been shown that a reasonable contact structure can readily be moved to close the contacts in a time period of less than 0.5 millisecond and that the terminal velocities can be of an acceptable magnitude to perform repeated operation without excessive contact damage.

It can now be shown that the use of a mechanical switch can result in reducing, by about a factor of 10, the number of solid state devices required to switch an acceptable level of current. In operation of the switching system, before closure of the mechanical switch, all current flows in the parallel solid state switching devices and after contact closure, the current through the mechanical contacts rapidly increases until substantially all current is conducted through these contacts. To obtain the rapid injection or commutation of current into the mechanical switch contacts, the series resistors 50 in FIG. 1 have been added in each thyristor branch circuit. An acceptable rate of current commutation can be obtained with resistor values which produce very small energy losses. For example, assume that four parallel connected thyristors are used in the switching system with each having a series resistance of 800 microohm and that the resistance of the mechanical contacts is 20 microohm. Under these assumptions, the four thyristors represent a parallel circuit resistance which is ten times that of the mechanical contact circuit branch. Under these conditions, the additional current increase after switch contact closure, that is, 300 kiloamp minus 216 kiloamp, will finally divide in about a 10 to 1 ratio which in turn yields a 100 to 1 ratio of instantaneous $I^2t$ values and thus, the minor effects of the additional current can be neglected.

The total resistive voltage drops in a four parallel thyristor system would be about 43 volts (216 $kA \times 200 \times 10^{-6}$ ohm) at the time of contact closure. The initial rate of change of current through the mechanical contacts can be closely estimated from the equation: $V = L\ di/dt$ where V is the 43 volts which commutates or injects the current into the mechanical switch branch and L is the total inductance of the mechanical switch conductor loop connected in series with the parallel array of thyristors. A reasonable estimate for this inductance is 0.15 microhenry and a compact switch design may lower this value. Assuming 0.15 microhenry, the initial current injection rate into the mechanical switch contacts and the resulting initial rate of current decay in the thyristors is about $287 \times 10^6$ A/s. In FIG. 3, this initial rate of current decay is indicated by the dashed line 70 and the solid line 68 represents an estimate of a somewhat slower more realistic current decay. The integral of the $I^2t$ through the thyristors can now be accurately calculated by assuming a straight line rise and a current decay of $Ie^{-at}$ which yields a value of $23.1 \times 10^6$ $A^2s$ and hence about 11% of the $210 \times 10^6$ $A^2s$ which is the total value for the per shot current pattern of FIG. 3. Therefore, it should be apparent that about a ten-fold reduction in $I^2t$ through the solid state switching devices can be achieved by using the mechanical switching device.

The energy losses per shot due to the resistors plus the thyristor internal resistance can now be calculated as follows: energy loss equals the integral of the power with respect to time, which under the assumed conditions is 4.6 kilojoule. In FIG. 3, the projectile accelerating current waveform in conjunction with a two meter parallel rail launcher configuration will result in a muzzle projectile kinetic energy of about 50 kilojoule. If an overall launcher efficiency of 25% is assumed, then the total energy required per shot is 200 kilojoule and the energy loss in the series resistors of 4.6 kilojoule then represents only a 2.3% energy dissipation with respect to the whole system. Additionally, the resistors in series with the thyristors assure that current is equally shared among the thyristors and thus even if the resistors were not required for speeding up commutation into the mechanical switch contacts, some suitable series impedance would still be required to assure near equal current sharing in the parallel connected switching elements.

Figure 4:
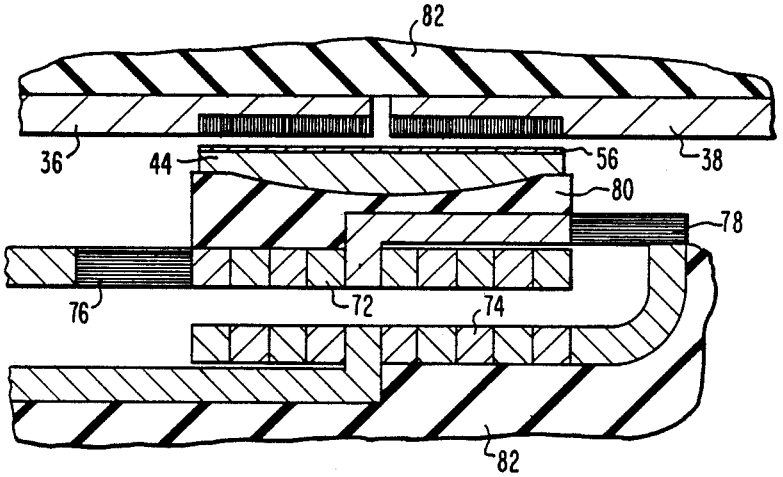
FIG. 4 is a cross-sectional view of an alternative mechanical switch for use in the switching system in the launcher of FIG. 1.

FIG. 4 shows an alternative embodiment of a mechanical switch which may be used in the switching system of this invention, but for lower currents. This switch includes a pair of pancake coils 72 and 74 which are closely spaced, coaxial, series connected and oppositely wound. Moving pancake coil 72 is electrically connected and mechanically supported by a pair of braided or leaf conductors 76 and 78. The contact shorting element 44 is then mounted on a resilient insulating member 80 which is attached to the pancake coil 72. The stationary members are restrained in a suitable supporting structure 82.

It should be pointed out that the assumptions used in the example system do not necessarily result in an optimized system. For example, with the same assumed current waveform and mass being accelerated, a precisely manufactured switch may utilize a contact stroke of only 0.5 millimeter which is quite feasible, particularly if the contacts are located in a gaseous medium such as sulfur hexafluoride. A shorter stroke would have the beneficial effect of causing contact closure in a calculated 302 microsecond at a reduced current magnitude of 181 kiloamp and at a more desirable lower contact impact velocity of 6.6 m/sec. This would beneficially reduce wear and reduce energy losses in the thyristors and their series resistors and may also reduce the required number of parallel connected thyristors. Additionally, the thyristor series resistances could be increased which will speed up current commutation into the mechanical contacts and may actually reduce the energy dissipated by these resistors.

Although the described preferred embodiments of this invention have used solid state thyristors as the controllable switching elements, it should be understood that other parallel switching elements may be used if they are capable of controlled current initiation and repeated operation at high currents for at least a brief period of time. Acceptable switching elements would therefore include tube type switches such as thyratrons and ignitrons. It should be further understood that the switching system of this invention may be used in any high current switching application which requires the extremely precise timing of current flow initiation that is provided by the controllable switching elements but in which the combination of high current and a relatively long current conduction period makes it desirable to reduce the number of parallel connected switching elements by rapidly providing a metallic conduction path in parallel with the controllable switching elements.

I claim:

1. A switching system for switching large electric currents comprising:

a plurality of controllable switching devices electrically connected in parallel with each other;

means for turning on said controllable switching devices;

a current actuated mechanical switch having a pair of contacts electrically connected in parallel with the parallel connection of said switching devices, said mechanical switch including means for shorting said mechanical contacts in response to current flow through said controllable switching devices, thereby limiting the energy dissipated in said controllable switching devices during each current switching operation;

wherein said means for shorting includes a fixed conductor, a movable conductor positioned adjacent to said fixed conductor and electrically connected in series with said fixed conductor, such that current flows in opposite directions in said fixed and movable conductors, and a shorting member attached to said movable conductor; and said fixed and movable conductors lying in parallel planes and being electrically connected in series with the parallel connection of said controllable switching devices such that initial current flow through said controllable switching devices also flows through said fixed and movable conductors resulting in electromagnetic forces between the fixed and movable conductors, which force said shorting member into electrical contact with said pair of contacts.

2. A switching system as recited in claim 1, wherein said fixed conductor and said movable conductor are each shaped to form a coil.

3. A switching system as recited in claim 1, further comprising:

a plurality of resistors, each of said resistors being electrically connected in series with one of said controllable switching devices to form a plurality of parallel connected branch circuits such that said pair of contacts is electrically connected in parallel with the parallel connection of said branch circuits.

4. A switching system as recited in claim 1, wherein said controllable switching devices are solid state devices.

5. An electromagnetic projectile launching system comprising:

a pair of generally parallel conductive rails;

means for conducting current between said rails and for propelling a projectile along said rails;

a pulse current source;

a switching system for switching current from said pulse current source to said rails, wherein said switching system includes a plurality of controllable switching devices electrically connected in parallel with each other, means for turning on said controllable switching devices, and a current actuated mechanical switch having a pair of contacts electrically connected in parallel with the parallel connection of said controllable switching devices, said mechanical switch including means for shorting said mechanical contacts in response to current flow through said controllable switching devices, thereby limiting the energy dissipated in said controllable switching devices during each current switching operation;

wherein said means for shorting includes a fixed conductor, a movable conductor positioned adjacent to said fixed conductor and electrically connected in series with said fixed conductor, such that current flows in opposite directions in said fixed and movable conductors, and a shorting member attached to said movable conductor;

said fixed and movable conductors lying in parallel planes and being electrically connected in series with the parallel connection of said controllable switching devices such that initial current flow through said controllable switching devices also flows through said fixed and movable conductors resulting in electromagnetic forces, between the fixed and movable conductors, which force said shorting member into electrical contact with said pair of contacts; and wherein said rails include an insulating portion positioned such that as said means for conducting current passes adjacent to said insulating portion, an arc is formed, with said arc being extinguished at a subsequent current zero.

6. An electromagnetic projectile launching system as recited in claim 5, wherein said fixed conductor and said movable conductor are each shaped to form a coil.

7. An electromagnetic projectile launching system as recited in claim 5, further comprising:

a plurality of resistors, each of said resistors being electrically connected in series with one of said controllable switching devices to form a plurality of parallel connected branch circuits such that said pair of contacts is electrically connected in parallel with the parallel connection of said branch circuits.

8. An electromagnetic projectile launching system as recited in claim 5, wherein said rails include a resistive portion positioned such that when said means for conducting current makes electrical contact with said resistive rail portion, resistance is added to the circuit to reduce the current magnitude.

9. An electromagnetic projectile launching system as recited in claim 5, wherein said controllable switching devices are solid state devices.

10. A method of electromagnetically accelerating a projectile comprising the steps of:

switching current from a pulse current source through a plurality of parallel connected controllable switching devices to a pair of projectile launching rails and through a means for conducting current between the rails and for propelling a projectile along the rails;

shorting said controllable switching devices through a pair of mechanical contacts, wherein said mechanical contacts close when a shorting member attached to a movable conductor is driven into electrical contact with said mechanical contacts as a result of electromagnetic forces between said movable conductor and a fixed conductor, said movable and fixed conductors being electrically connected in series with the parallel connection at controllable switching devices such that initial current flow in said movable and fixed conductors is equal to current flow through said controllable switching devices, thereby limiting the energy dissipated in said controllable switching devices during each switching operation; and interrupting current flow between said projectile launching rails, following the launch of a projectile and before opening said mechanical contacts.

11. The method of claim 10, wherein said step of shorting of said controllable switching devices through said mechanical contacts allows the use of a smaller number of parallel controllable switching devices than would be required in the absence of said mechanical contacts for each switching operation.

12. The method of claim 10, wherein said step of shorting of said controllable switching devices through said mechanical contacts reduces the length of time during which current is conducted through said controllable switching devices for each switching operation.

* * * * *